US005168577A

United States Patent [19]

Detty

[11] Patent Number: 5,168,577

[45] Date of Patent: Dec. 8, 1992

[54] ELBOW AND KNEE SLEEVE WITH SEAMS ON OPPOSITE SURFACES

[75] Inventor: Gerald D. Detty, Tucson, Ariz.

[73] Assignee: Pro Orthopedic Devices, Inc., Tucson, Ariz.

[21] Appl. No.: 861,735

[22] Filed: Apr. 1, 1992

[51] Int. Cl.[5] ..... A41D 13/00

[52] U.S. Cl. ..... 2/16; 2/24; 602/62

[58] Field of Search ..... 2/16, 20, 22, 24, 59, 2/61, 62, 125, 126; 602/62, 63, 64, 65, 20, 23, 26, 21

[56] References Cited

U.S. PATENT DOCUMENTS

| | | | |
|---|---|---|---|
| D. 278,566 | 4/1985 | Gustafson | 2/59 X |
| 946,541 | 1/1910 | Fletcher | 2/59 |
| 1,304,558 | 5/1919 | Carau | 2/59 |
| 1,665,507 | 4/1928 | Pollak | 2/62 |
| 1,846,835 | 2/1932 | Bruckler | 2/24 |
| 3,416,518 | 12/1968 | Samuels et al. | 2/16 |
| 3,421,503 | 1/1969 | Kaplan | 602/62 |
| 3,648,291 | 3/1972 | Pankers | 2/22 X |
| 4,632,106 | 12/1986 | Gamm | 602/63 |
| 4,832,010 | 5/1989 | Lerman | 128/165 |
| 4,986,263 | 1/1991 | Dickerson et al. | 2/22 X |

FOREIGN PATENT DOCUMENTS

| | | | |
|---|---|---|---|
| 489270 | 1/1928 | Fed. Rep. of Germany | 2/59 |
| 1306115 | 9/1961 | France | 2/16 |

*Primary Examiner*—Werner H. Schroeder
*Assistant Examiner*—Amy Brooke Vanatta
*Attorney, Agent, or Firm*—Caesar, Rivise, Bernstein, Cohen & Pokotilow, Ltd.

[57] ABSTRACT

A sleeve with the horizontal seam worn on the medial side of the elbow or knee and a vertical seam worn on the lateral side of the joint disclosed. Placing the seams on opposite sides of the sleeve prevents bunching of material on the medial side opposite the knee or elbow when the limb is bent. The vertical seam on the lateral side of the knee or elbow reduces irritation in the particularly sensitive areas on the medial side which would occur if the vertical seam were on the medial side of the limb. The elbow sleeve is made of a double laminate with an elastomeric material such as neoprene on the outside and a polymer material such as nylon on the inside. The outside surface on the elbow brace is patterned to produce a roughened textured surface so the ball may be carried in the crook of the arm without slippage. The knee brace is made of a triple laminate with elastomeric material such as neoprene sandwiched between two layers of nylon. Alternatively, the elbow sleeve can also be made of a triple laminate with elastomeric material sandwiched between two layers of nylon.

28 Claims, 3 Drawing Sheets

ELBOW AND KNEE SLEEVE WITH SEAMS ON OPPOSITE SURFACES

FIELD OF THE INVENTION

The present invention relates to elbow and knee sleeves intended to prevent or alleviate injuries and more particularly to elbow and knee sleeves with seams on opposite surfaces of the sleeves.

Elbow and knee sleeves are usually made of a single piece of material into which a cut-out has been made to remove material. A horizontal seam is sewn to connect the edges formed by the opening created by the cut-out. A vertical seam, which joins the longitudinal edges of the material, is then sewn to form a cylindrically-shaped sleeve for application to the knee or elbow of the user. Thus, there is a horizontal seam directly opposite the knee or elbow, and a vertical seam, which intersects the horizontal seam perpendicularly, on the medial side of the joint.

Although the cut-out tends to shape the sleeve so that when full flexation occurs bunching up of material is reduced, the vertical seam in conjunction with the horizontal seam tends to increase the bunching. U.S. Pat. No. 4,832,010 (Lerman) discloses a knee sleeve with seams arranged in such a cruciform fashion on the medial side of the leg (FIGS. 1 and 2).

The placement of both the horizontal seam and the vertical seam intersecting each other perpendicularly, on the medial side of the sleeve, causes various problems for athletes using the sleeves. In particular, with football players who run with the ball carried in the crook of the arm, such as running backs or receivers, the vertical seam and the bunching up of the sleeve material at the inside of the elbow makes carrying the ball securely more difficult. Furthermore, the cruciform arrangement of the seams tends to irritate the areas behind the knee (the popliteal area) and opposite the elbow, which are extremely sensitive. This is due to the positioning of the vertical seam on the medial side of the joint and the bunching up of sleeve material when the joint is flexed.

OBJECTS OF THE INVENTION

Accordingly, it is the general object of this invention to provide an elbow and a knee sleeve which overcome the shortcomings of present sleeves.

It is a further object of this invention to provide an elbow and a knee sleeve made of an elastomeric material which is flexible and resilient.

It is yet a further object of the instant invention to provide an elbow and a knee sleeve which minimizes bunching up of the sleeve material when the joint is flexed.

It is another object of the instant invention to provide an elbow sleeve which is a laminate made of an elastomeric material, such as neoprene, laminated to a polymer material, such as nylon.

It is yet another object of the instant invention to provide an elbow sleeve with smooth nylon on the inner surface and textured neoprene on the outer surface to prevent slippage of a ball carried in the crook of the arm.

It is still yet another object of the instant invention to provide a knee and an elbow sleeve which is made of a laminate with two outer layers, such as nylon, and an inner layer of elastomeric material such as neoprene.

SUMMARY OF THE INVENTION

These and other objects of this invention are achieved by providing a sleeve which is made of a unitary piece of material. A cut-out is made equidistant from the longitudinal edges of the material, and the material removed. The periphery of the opening created by the removed material is then sewn closed providing for a horizontal seam which is generally perpendicular to, and equidistant from, the longitudinal edges of the material. The longitudinal edges are then sewn together to form a cylindrically-shaped sleeve, thereby creating a vertical seam. When the sleeve is worn on the elbow or the knee of the user, the vertical seam is on the lateral side of the elbow or knee and the horizontal seam is on the opposite side of the sleeve, the medial side of the elbow or knee, at the bend of the joint.

The elbow sleeve comprises a laminate with a layer of polymer material, such as nylon, and a layer of elastomeric material, such as neoprene. When the vertical seam is sewn, the neoprene is on the outside surface of the sleeve while the nylon is on the inside surface of the sleeve. The neoprene is patterned to create a rough surface, to additionally secure a ball, such as a football, carried in the crook of the arm, while the inside nylon surface against the skin is smooth to prevent skin irritation.

For the knee sleeve, both the inside and outside surfaces are made smooth to prevent problems on falling or sliding with the knee area in contact with the ground. The knee sleeve comprises a triple laminate with outer layers of a polymer material, such as nylon, and an inside layer of elastomeric material, such as neoprene. An opening may be cut on the lateral side of the sleeve to allow for protruding of the patella when the sleeve is worn.

An alternative embodiment of the elbow sleeve comprises a triple laminate with two outer layers of a smooth polymer and an inner layer of elastomeric material as is used for the knee brace. This is suitable for long term therapeutic wear in cases of elbow injury, inflammation or chronic conditions such as tendonitis.

DESCRIPTION OF THE DRAWING

Other objects have many of the intended advantages of this invention will be readily appreciated when the same becomes better understood by reference to the following detailed description, when considered in connection with the accompanying drawing wherein.

DETAILED DESCRIPTION OF THE PREFERRED EMBODIMENT

Figure 1:
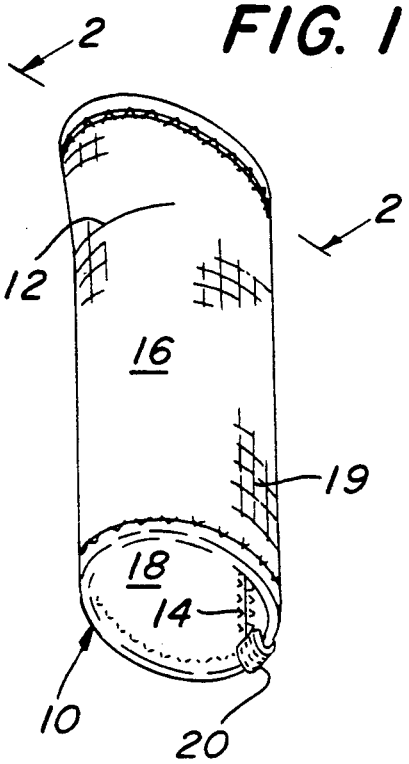
FIG. 1 is a perspective view of the instant invention.
Figure 2:
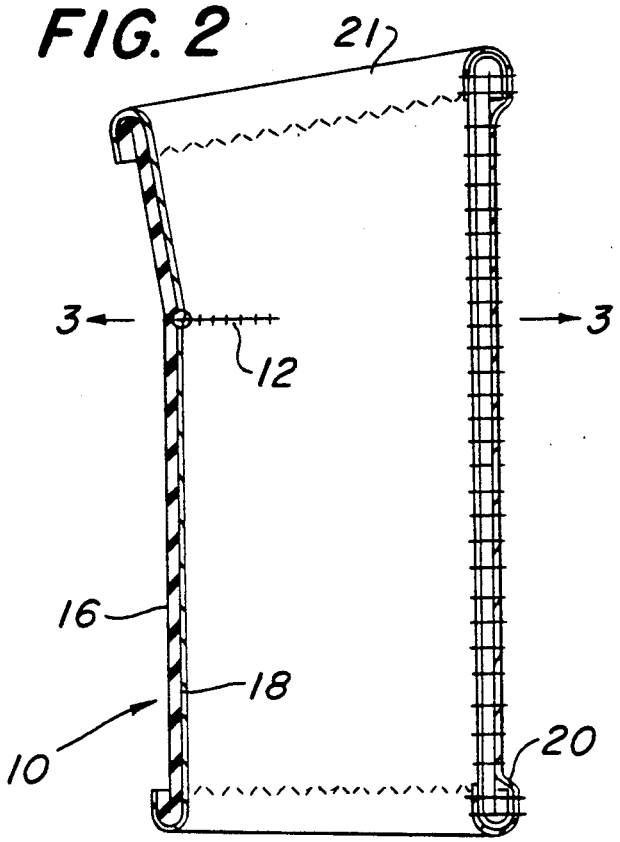
FIG. 2 is a vertical sectional view of a double laminate elbow sleeve taken along the line 2—2 of FIG. 1.

Referring no in greater detail to the various Figs. of the drawing, wherein like references and characters refer to like parts, in elbow sleeve 10 is shown in FIGS. 1 and 2. The elbow sleeve comprises a laminate having an outer layer 16 and an inner layer 18. The outer layer 16 is made of an elastomeric material such as neoprene, while the inner layer 18 comprises a polymer material such as nylon. When the elbow sleeve is worn, the horizontal seam 12 is positioned on the medial side of the arm at the fold directly opposite the elbow while the vertical seam 14 is positioned on the lateral side of the arm directly over the elbow.

A binding 20 made of an elastic type of material is sewn directly over the vertical seam, to hold the seam together. Other methods for closing the seam, such as gluing and sewing or heat taping the seam closed, may be used.

A hem 21 may be sewn at the top of the elbow brace by folding the outer layer 16 over the inner layer 18 and stitching the flap thereby created to the inner layer 18 to give it a more finished look. It should be noted that the inner layer 18 which is directly against the arm of the user has a smooth surface while a pattern 19 has been placed on the outer layer 16 to provide a textured rough surface. The purpose of the textured surface will be explained later.

Figure 4:
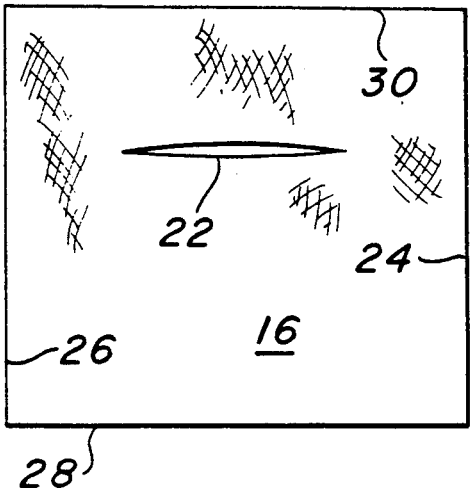
FIG. 4 is a plan view of the material used in manufacturing an elbow sleeve of the instant invention showing the cut-out material removed.
Figure 5:
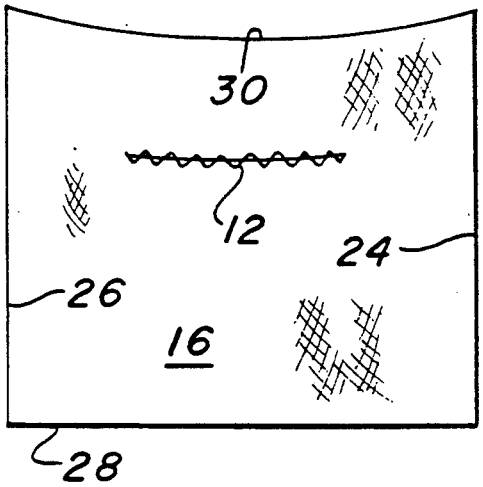
FIG. 5 is a plan view of the material for the elbow brace with the cut-out portion of the material sewn together with a horizontal seam.

FIGS. 4 and 5 show how the elbow sleeve is constructed. An oval cut-out 22 is first made in the laminated material. The cut-out has a long axis which is generally perpendicular to the right edge 24 and to the left edge 26 and parallel to the top edge 30 and the bottom edge 28 of the material. As can be seen in FIG. 5 the edges of the oval cut-out 22 are sewn together with a horizontal seam 12. The right and left edges 24 and 26 are then sewn together with a vertical seam 14 as seen in FIG. 1. The vertical seam thereby creates a generally cylindrical sleeve. When the sleeve is worn over the elbow with the horizontal seam on the medial side opposite the elbow and the vertical seam over the elbow, the cut-out material prevents bunching at the elbow. In existing sleeves the vertical and horizontal seams are sewn on the same side of the sleeve and worn on the medial side of the elbow, which causes increased bunching and irritation because the seams are on the same side of the sleeve and intersect with each other.

The sleeve of the instant invention, for example, is suited to the carrying of a football for a running back or a receiver. Since the football is carried in the crook of the arm, it is held more securely because the vertical seam is not on the inside of the arm and the bunching at the elbow is considerably lessened. Furthermore, the roughening of the outer surface 16 with the pattern 19 enables the football to be held more securely by preventing slippage of the ball.

Figure 2A:
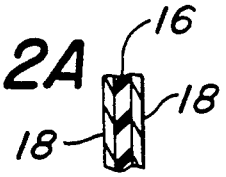
FIG. 2A is a sectional view of the material used for a triple layer laminate elbow sleeve.
Figure 3:
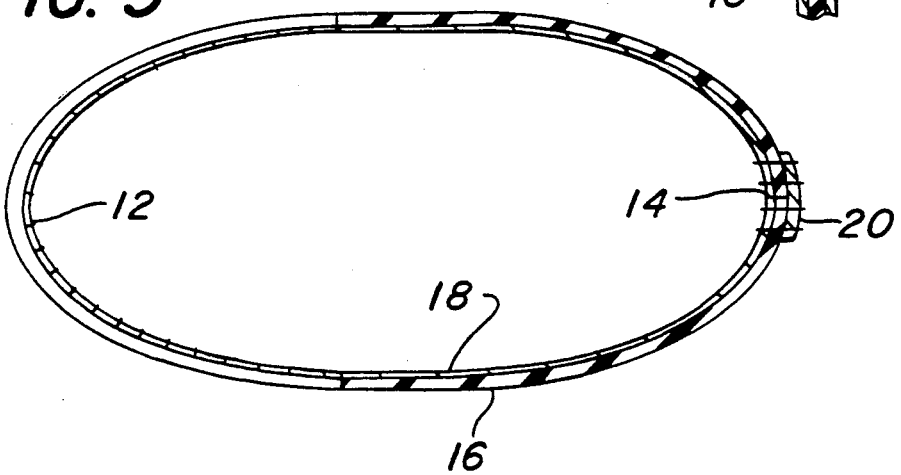
FIG. 3 is a horizontal sectional view of the elbow sleeve taken along the line 3—3 of FIG. 2.

FIG. 2A shows an alternative embodiment of elbow sleeve 10 which is made of a triple layer laminate with inner and outer layers 18 of a polymer material such as nylon, and a middle layer 16 of an elastomeric material such as neoprene. This is useful in non-athletic, extended-wear therapeutic situations to treat injury or elbow inflammation. In this case, the inner and outer surfaces are smooth and the movement of the vertical seam to the elbow side of the arm prevents irritation on the sensitive inside of the elbow.

The design and manufacture of a knee sleeve made in accordance with the instant invention will now be described.

Figure 6:
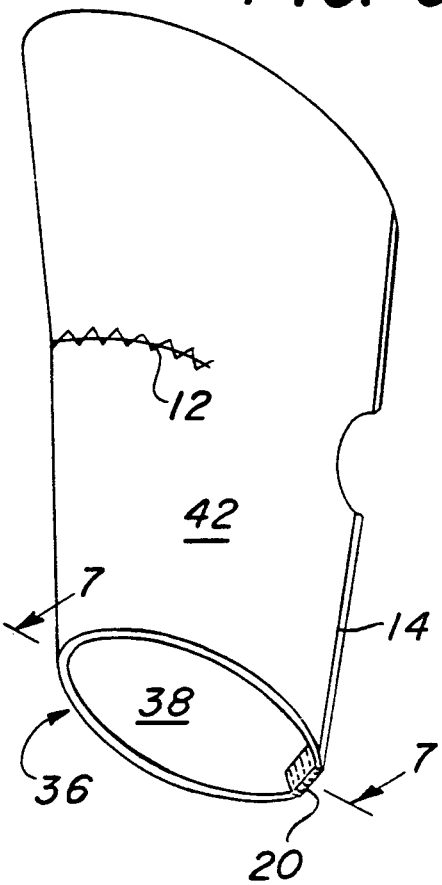
FIG. 6 is a perspective view of the knee sleeve of the instant invention.
Figure 7:
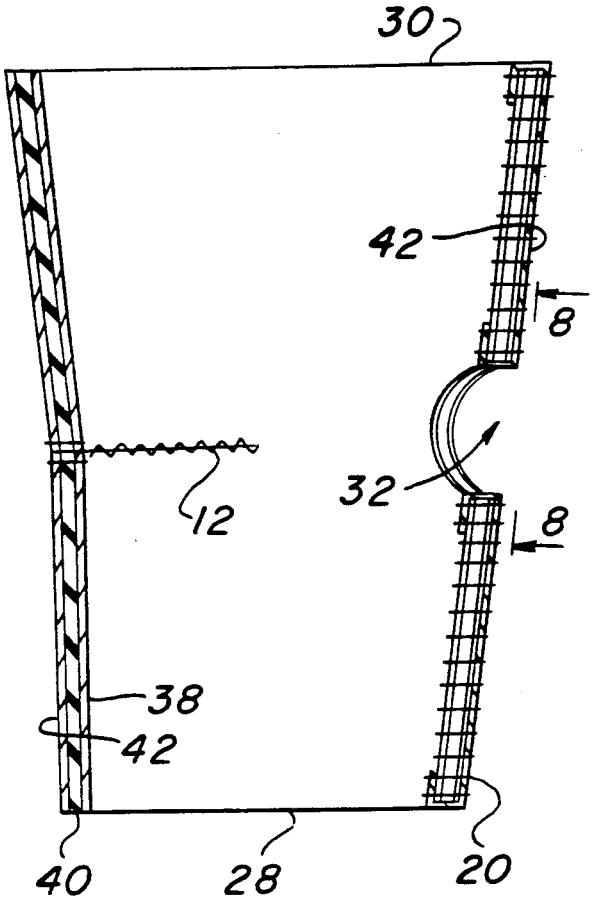
FIG. 7 is a vertical sectional view of the knee sleeve taken along the line 7—7 of FIG. 6.
Figure 8:
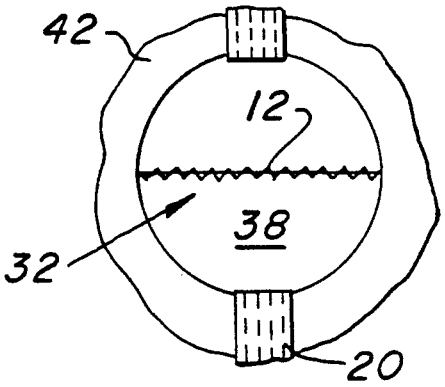
FIG. 8 is a front view of the cut-out for the knee cap of the knee sleeve taken along the line 8—8 of FIG. 7.

FIGS. 6, 7 and 8 show various views of the knee sleeve 36. As can be seen, vertical seam 14 has been sewn on one side of the sleeve with horizontal seam 12 on the other side of the sleeve. The sleeve is worn with the horizontal seam 12 on the medial side of the leg opposite the knee and the vertical sea 14 on the lateral side of the leg. A cut-out 32 made be made to allow the knee cap or patella of the knee to protrude through the sleeve. As can be seen in FIG. 7, the sleeve comprises a triple laminate with a middle layer 40 sandwiched between inner layer 38 and outer layer 42. The middle layer 40 can be made of an elastomeric material such as neoprene while the inner and outer layers 38 and 42, respectively, can be made of a polymer material such as nylon. It should also be noted that the outer layer 42 and the inner layer 38 both have smooth surfaces unlike the elbow brace with textured roughened outer layer. This is to prevent injury in case the athlete falls and his leg is scraped along the ground. A binding 20, which can be made of elastic material, is sewn over the vertical seam 14, although other means to close the seam can be used, as described for the elbow sleeve.

Figure 9:
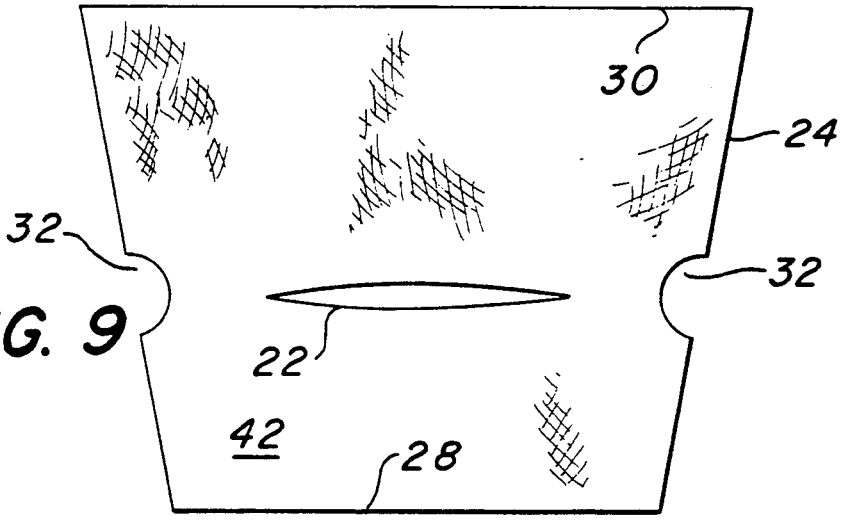
FIG. 9 is a plan view of the knee sleeve material with a horizontal oval cut-out and cut-outs at each of the side edges to allow for protrusion of the knee.
Figure 10:
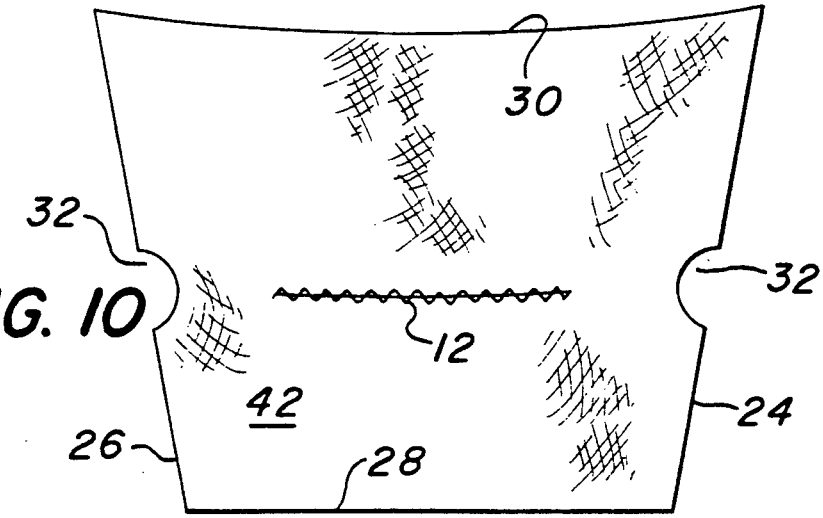
FIG. 10 is a plan view of the material of the knee sleeve with a horizontal oval cut-out sewn together to form a horizontal seam.

FIGS. 9 and 10 show how the knee brace is made. The oval horizontal cut-out 22 is made in the material between right edge 24 and left edge 26. Cut-outs 32 are also made in the right and left edges 24 and 26, respectively, to allow the patella to protrude.

FIG. 10 shows a horizontal seam 12 made when the edges of the oval cut-out 22 are sewn together. Left edge 24 and right edge 26 are sewn together by vertical seam 14 creating a generally cylindrical sleeve 36 shown in FIG. 6.

As in the case of the elbow sleeve, placing the horizontal seam 12 on the side opposite the vertical seam 14 reduces bunching as well as chafing or irritation on the medial side of the leg opposite the knee. Furthermore, because the popliteal area behind the knee is particularly sensitive, the design of the knee sleeve avoids the irritation caused when the vertical seam is placed on the medial side of the knee sleeve.

The knee brace may also be worn in non-athletic therapeutic situations such as in the treatment of knee injuries, inflammatory or chronic conditions.

A sleeve has been described which when worn at the elbow or the knee has a horizontal seam on the medial side of the limb and a vertical seam on the lateral side of the limb. This results in a sleeve which minimizes bunching opposite the joint and is more comfortable to wear because it reduces irritation in the sensitive areas on the medial side of the limb.

Without further elaboration, the foregoing will so fully illustrate my invention that others, may by applying current or future knowledge, readily adapt the same for use under the various conditions of service.

What is claimed is:

1. A sleeve for application to a joint on the body of a user, such sleeve comprising:

(a) a piece of material having right and left and bottom and top edges with an area of said material removed, said area lying between, and being equidistant from, said right and left edges;

(b) a horizontal seam, closing said area of removed material, said seam being generally perpendicular to said right and left edges and being generally parallel to said top and bottom edges, said seam lying between, and having ends which are equidistant from, said right and left edges respectively; and (c) a vertical seam connecting said right and left edges together to form a generally cylindrical sleeve.

2. The sleeve of claim 1 wherein said area is elliptical in shape with major axis generally parallel to said top and bottom edges and a minor axis generally perpendicular to said top and bottom edges.

3. The sleeve of claim 2 wherein said material, for use as an elbow brace, comprises a laminate having an inner layer and an outer layer.

4. The sleeve of claim 3 wherein said inner layer comprises a polymer material and said outer layer comprises an elastomeric material.

5. The sleeve of claim 4 wherein said outer layer comprises neoprene, with a patterned surface, and said inner layer comprises nylon with a smooth surface.

6. The sleeve of claim 5 wherein said sleeve further comprises a hem sewn at said top and bottom edges formed by folding said top and bottom edges of said inner layer over said outer layer and stitching said folded edges to said outer layer.

7. The sleeve of claim 5 wherein said sleeve further comprises a means for covering said vertical seam.

8. The sleeve of claim 1 wherein said material comprises a laminate with an inner layer and an outer layer.

9. The sleeve of claim 8 wherein said inner layer comprises a polymer material and said outer layer comprises an elastomeric material.

10. The sleeve of claim 9 wherein said sleeve further comprises a means for covering said vertical seam.

11. The sleeve of claim 3 wherein said sleeve further comprises a means for covering said vertical seam.

12. The sleeve of claim 1 wherein said sleeve comprises a knee brace and said material is a laminate.

13. The sleeve of claim 12 wherein said laminate comprises three layers, said layers comprising two outer layers of polymer material with an inner layer of elastomeric material.

14. The sleeve of claim 13 wherein said outer layers comprise nylon and said inner layer comprises neoprene.

15. The sleeve of claim 14 wherein said sleeve further comprises a means for covering said vertical seam.

16. The sleeve of claim 15 wherein said means for covering said vertical seam comprises a binding of elastic material.

17. The sleeve of claim 1 wherein said sleeve comprises an elbow brace and said material comprises a laminate with two outer layers and one inner layer.

18. The sleeve of claim 17 wherein said outer layers comprise a polymer material and said inner layer comprises an elastomeric material.

19. The sleeve of claim 18 wherein said outer layers comprise nylon and said inner layer comprises neoprene.

20. A method for manufacture of a sleeve to be worn at a joint on the body of a user comprising the steps of:

(a) providing a piece of material with right and left edges and top and bottom edges;

(b) cutting said material and removing a section of said material which is centered between, and equidistant from, said right and left edges;

(c) sewing the periphery of an opening created by removing said section, closed to form a horizontally disposed seam which is generally perpendicular to said right and left edges and, which has ends each of which is equidistant from said right and left edges respectively;

(d) folding said material so that said right and left edges are coincident with each other; and (e) sewing said right and left edges together to form a vertical seam thereby creating a cylindrically-shaped sleeve which when worn by said user positions said vertical seam on the lateral side of said joint and positions said horizontal seam on the medial side of said joint, diametrically opposite said vertical seam.

21. The method of claim 20 wherein, for use of said body sleeve as an elbow brace, said method further includes the step of laminating a sheet of polymer material to a sheet of elastomeric material to produce said material.

22. The method of claim 21 further including the step of covering said vertical seam.

23. The method of claim 22 wherein the step of laminating said sheet of polymer material to said sheet of elastomeric material comprises laminating a sheet of nylon to a sheet of neoprene.

24. The method of claim 20 wherein, for use of said sleeve as an elbow brace, said method further comprises the step of laminating a sheet of elastomeric material between two sheets of polymer material.

25. The method of claim 24 wherein said step of laminating a sheet of elastomeric material between two sheets of polymer material comprises laminating a sheet of neoprene between two sheets of nylon.

26. The method of claim 20 wherein, for use of said body sleeve as a knee brace, said method further includes the step of cutting out areas at said left and right edges to form an opening to allow the patella of the user to protrude when said sleeve is worn.

27. The method of claim 26 further including the step of laminating a sheet of elastomeric material between two sheets of polymer material to produce said material.

28. The method of claim 27 wherein said step of laminating a sheet of elastomeric material between two sheets of polymer material comprises laminating a sheet of neoprene between two sheets of nylon.

* * * * *